United States Patent [19]

Blomberg

[11] Patent Number: 4,793,538

[45] Date of Patent: Dec. 27, 1988

[54] ARRANGEMENT FOR THE MANUAL BREAKING OF AMPOULES

[75] Inventor: Anders Blomberg, Kungsbacka, Sweden

[73] Assignee: AB Västsvensk Medicinteknik, Sweden

[21] Appl. No.: 133,149

[22] PCT Filed: Jul. 14, 1986

[86] PCT No.: PCT/SE86/00335

§ 371 Date: Sep. 17, 1987

§ 102(e) Date: Sep. 17, 1987

[87] PCT Pub. No.: WO87/03195

PCT Pub. Date: Jun. 4, 1987

[30] Foreign Application Priority Data

Nov. 25, 1985 [SE] Sweden ..... 8505542

[51] Int. Cl.[4] ..... A61J 1/08

[52] U.S. Cl. ..... 225/93; 241/99

[58] Field of Search ..... 225/93, 104, 1, 2; 241/99

[56] References Cited

U.S. PATENT DOCUMENTS

| | | | |
|---|---|---|---|
| 2,659,253 | 11/1953 | Myrick | 241/99 X |
| 3,450,319 | 6/1969 | Ray et al. | 225/104 |
| 3,552,083 | 1/1971 | Andersen et al. | 241/99 X |
| 4,659,024 | 4/1987 | Frunzi et al. | 225/93 X |

*Primary Examiner*—Frank T. Yost

*Attorney, Agent, or Firm*—29

[57] ABSTRACT

An arrangement for the manual breaking of ampoules comprising a base part (1) so arranged as to maintain in position one end of an ampoule, and projecting upwards from the base part a side support part (2) so arranged as to provide lateral support for the ampoule (16). The supporting part exhibits two finger support surfaces for the fingers of a user. These finger support surfaces extend to either side of the other end (18) of the ampoule, so that this projects partly into a space (6) between the finger support surfaces. Before the moment of breaking, the other end of the ampoule thus projects slightly beyond the connecting line between the aforementioned finger support surfaces. At the moment of breaking, the broken-off end is introduced into the aforementioned space by the fingers of the user being squeezed together with the side supporting part and the head of the ampoule in between.

4 Claims, 2 Drawing Sheets

ARRANGEMENT FOR THE MANUAL BREAKING OF AMPOULES

The present invention relates to an arrangement for the manual breaking of ampoules comprising a base part so arranged as to maintain in position one end of an ampoule, and projecting upwards from the base part a side support part so arranged as to provide lateral support for the ampoule. TECHNICAL BACKGROUND Ampoules are used widely in the medical care field to contain a certain quantity of a liquid drug or similar under hygienic conditions. The ampoules consist of small glass containers which are opened by breaking the ampoule. This is usually done without any form of instrument, thereby exposing the staff to the risk of injury by cuts to the fingers caused by the sharp edges of the glass. The arrangement of devices for breaking an ampoule is previously disclosed, although these are usually complicated to use and contain moving parts.

Technical problem

The object of the present invention is to provide an arrangement for breaking ampoules which is simple to use, does not contain any moving parts, and also affords a holder for the ampoule both before and after breaking.

The solution

The aforementioned object is achieved by means of an arrangement in accordance with the present invention, which is characterized in that the supporting part exhibits two finger supporting surfaces for the fingers of a user, which finger supporting surfaces extend to either side of at least the other end of the ampoule, so that this projects partly into a space between the finger supporting surfaces, so that before the moment of breaking the other end of the ampoule projects slightly beyond the connecting line between the aforementioned finger supporting surfaces, and at the moment of breaking is introduced into the aforementioned space by the fingers of the user being squeezed together with the side supporting part and the head of the ampoule in between.

BRIEF DESCRIPTION OF THE DRAWINGS

The invention is described below in greater detail in relation to an illustrative embodiment with reference to the accompanying drawings, in which.

Figure 1:
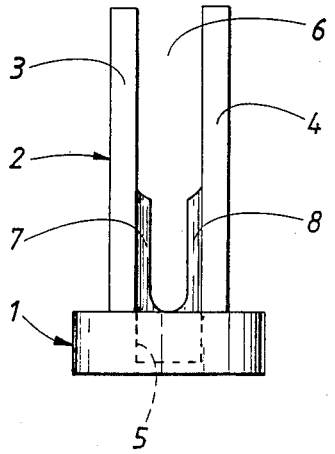
FIG. 1 shows a side view of an arrangement in accordance with the invention.
Figure 2:
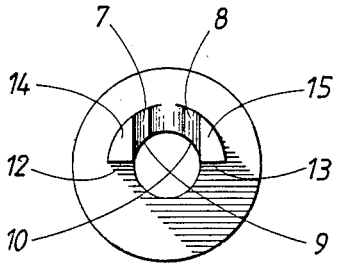
FIG. 2 shows a view of the arrangement from above.

BEST MODE OF CARRYING OUT THE INVENTION:

As will most easily be appreciated from FIGS. 1 and 2, the arrangement for the breaking of ampoules consists of a base part 1 and a side supporting part 2 projecting upwards from the base part in the form of two supporting elements 3, 4. The base part is executed as an essentially cylindrical plate with a similarly cylindrical hollow 5 having a diameter which slightly exceeds the diameter of the ampoule which is to be broken, more specifically the dimension at the lower part of the ampoule. The two supporting elements 3, 4 are executed as two bar-shaped elements which are securely attached at the bottom to the base part 1 by, for example, being executed in a single piece with the base part 1. Each of the supporting elements exhibits at the top a height which extends down below the point of breaking of the ampoule with an ampoule placed in the arrangement 1, each having a supporting part 7, 8 projecting into the space 6 between the two supporting elements. Each of these two supporting parts 7, 8 exhibits its own concave supporting surface 9, 10, which has a curve of the same shape as the shape of the ampoule, that is to say a curve in the form of the generating surface of a cylinder. Above these parts in the example illustrated the supporting elements 3, 4 exhibit a mutual distance which at least exceeds the transverse dimension, that is to say the diameter of the upper part or the head 11 of the ampoule. In the illustrated example the mutual distance is actually slightly greater than the transverse dimension or the diameter of the widest part of the ampoule.

The bar-shaped supporting elements 3, 4 exhibit finger supporting surfaces 12, 13 which, in the example illustrated, are plane and form a front surface for the entire height of the supporting elements, although the necessary effective part consists of those parts which are situated above the supporting parts 7, 8 for the ampoule. The rear parts of the supporting elements 3, 4, essentially like the rearward-facing edge parts 14, 15, form holding devices for the hand when breaking an ampoule.

Figure 4:
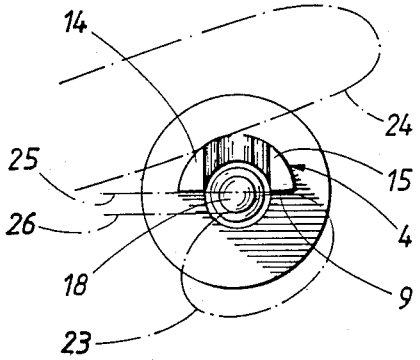
Figure 5:
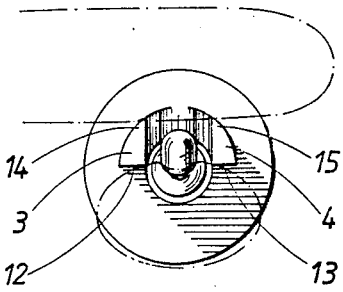

The arrangement in accordance with the invention is used in the following manner, as will be appreciated from FIGS. 3, 4 and 5. The arrangement in accordance with the invention, which is referred to below as the ampoule breaker for the sake of simplicity, can stand on a table or similar in its storage position, and can also be placed on a table during use, although it can also be held in the hand. The ampoule is usually executed essentially in the manner illustrated in the Figures with a holder part 16 which accommodates the liquid contained inside the ampoule. Executed above the holder part is a neck 17, which marks the limit of a head 18 which communicates with the holder part 16 but does not accommodate any of the liquid with the ampoule upright. Arranged in the neck is a fracture notch 19 in the form of a score in the glass material of which the ampoule is preferably made. The ampoule is placed in an ampoule breaker with the lower part 20 of the ampoule resting in the hollow 5 in the base part 1. This is appropriately so dimensioned that the ampoule rests with its lower part against the bottom 21 of the hollow and is given support against the side surfaces 22 of the hollow in the form of the generating surface of a cylinder so as to restrict any tendency to tipping over. For practical reasons a clearance is provided between the side surfaces and a clearance is provided between the side surfaces and the surface of the ampoule in the form of the generating surface of a cylinder, so that the ampoule is capable of being inserted and removed with ease, at the same time as which a tolerance is necessary in order to adapt to certain dimensional variations of the ampoules. As will be appreciated from the Figures, the concave ampoule supporting surfaces 9, 10 constitute an upward extension of two zones of the side surfaces 22 of the hollow, so that the ampoule supporting surfaces accordingly provide a support for the holder part 16 of the ampoule, in particular at the moment of breaking.

Figure 3:
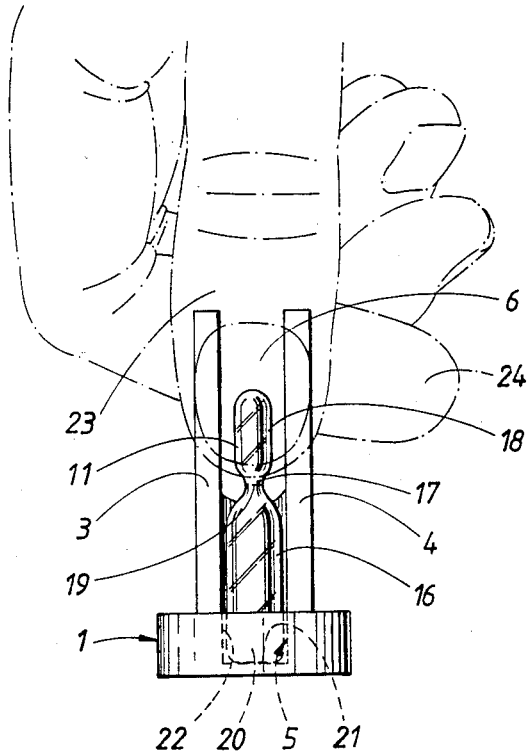
FIGS. 3, 4 and 5 show the application of the arrangement.

Breaking of the ampoule is effected by gripping with the hand around both the bar-shaped supporting elements 3, 4 of the ampoule breaker, for example in the manner which can be appreciated from FIG. 3, which shows the hand of a user with dotted and dashed lines. For this purpose the thumb 23 is placed against the head 18 of the ampoule (see the thumb illustrated schematically in FIG. 4), in conjunction with which the index finger 24 of the hand, which is also shown in FIG. 4, is appropriately applied against at least one edge part 14, which thus forms a kind of holder device for the hand. For example, the thumb is applied at a slight angle so that it receives support against only the finger supporting surface 9 of the one supporting element, in conjunction with which slight pressure is applied against the head 18 of the ampoule simply by squeezing together the thumb 23 and the index finger 24 with the ampoule breaker and the head of the ampoule in between. Because, as shown in FIG. 4, the head 18 of the ampoule is situated with its front side (see the line 26) in front of the connecting line 25 between the two finger supporting surfaces 12, 13, the head 18 of the ampoule is thus subjected to a force applied across the longitudinal axis of the ampoule and in the space 6 between the two bar-shaped supporting elements 3, 4. This laterally applied force means that the ampoule with its holder part 16 is forced against the ampoule supporting surfaces 7, 8 and against the side surfaces 22 of the hollow 5, in conjunction with which the holder part of the ampoule is supported against its tendency to tip over, which mean that the head 18 of the ampoule is broken at the fracture notch 19. During this operation the thumb will also come into contact with the finger supporting surface 12 of the second supporting element 3. As will be appreciated from the Figures, the distance between the finger supporting surfaces 12, 13 and the associated holding devices is marginally greater than the transverse dimension or the diameter of the head 18 of the ampoule, thereby ensuring that the head of the ampoule is not crushed between the fingers, with the consequent risk of injury by cuts.

The ampoule is now open, and its holder part 16 is still present in the ampoule breaker and can also adopt that position when the contents are used, for example by being sucked up into an injection syringe. The holder can then be removed from the ampoule breaker.

The invention is not restricted to the illustrative embodiment described above and illustrated in the drawings, but can be modified in many ways within the scope of the following Patent Claims. For example, it is conceivable for the ampoule breaker to be provided with a rounded underside and a weight which endeavours to prevent the ampoule breaker from tipping over, which can make it easier to use the ampoule breaker, which with advantage is inclined slightly during use. In addition, the two ampoule supporting parts 7, 8 can be formed from a common part, which in this case is given essentially the form of the generating surface of a semicylinder. In addition, the space 6 between the two bar-shaped supporting elements 3, 4 can thus be smaller than that illustrated, although it should exceed the transverse dimension of the head of the ampoule. The hollow 5 can be an at least partially transcurrent hole in the base part 1, but must exhibit some form of supporting device or lip, so that the ampoule cannot be introduced through the base part. The various supporting surfaces can have a form other than the indicated form. The ampoules can contain a liquid other than a drug, and can be used in entirely different areas from the medical care field.

I claim:

1. An arrangement for the manual breaking of ampoules comprising a base part (1) so arranged as to maintain in position one end of an ampoule, and projecting upwards from the base part a side supporting part (2) so arranged as to provide a lateral support for the ampoule (16), characterized in that the supporting part exhibits two finger supporting surfaces (12, 13) for the fingers of a user, which finger supporting surfaces extend to either side of at least the other end (18) of the ampoule, so that this projects partly into a space (6) between the finger supporting surfaces, so that before the moment of breaking the other end of the ampoule projects slightly beyond a connecting line (25) between the aforementioned finger supporting surfaces, and at the moment of breaking is introduced into the aforementioned space by the fingers of the user being squeezed together with the side supporting part and the head of the ampoule in between.

2. An arrangement in accordance with patent claim 1, characterized in that the base part (1) exhibits a hollow (5) into which one end of the ampoule is intended to project and to receive support partly against the bottom (21) of the hollow and partly against the side surfaces (22) of the hollow, and in that the side supporting part consists of two essentially bar-shaped elements which are securely attached at the bottom to the base part and exhibit not only supporting surfaces (9, 10) for the ampoule facing towards the base part (1), but also the aforementioned finger supporting surfaces (12, 13) arranged at a certain distance from the base part and situated beyond the aforementioned supporting surfaces for the ampoule.

3. An arrangement in accordance with patent claim 2, characterized in that the aforementioned space (6) extends above the aforementioned supporting surfaces (9, 10) for the ampoule and exhibits a width which exceeds the width of at least the aforementioned other end of the ampoule.

4. An arrangement in accordance with patent claim 3, characterized in that the side of the bar-shaped supporting elements (3, 4) facing away from the ampoule presents at the top to either side of the aforementioned space (6) rest devices for another of the fingers of the user, for which purpose the aforementioned rest device on each of the two supporting elements is situated at a certain distance from the corresponding finger supporting surface (12, 13), which is less than the transverse dimension of the aforementioned other end (18) of the ampoule, that is to say the end which is introduced into the aforementioned space (6) after the moment of breaking.

* * * * *